US005456374A

United States Patent [19]

Beck

[11] Patent Number: 5,456,374

[45] Date of Patent: Oct. 10, 1995

[54] TAMPER EVIDENT CONTAINER CLOSURE

[76] Inventor: Matthew R. Beck, 1608 W. John, Champaign, Ill. 61821

[21] Appl. No.: 308,134

[22] Filed: Sep. 19, 1994

[51] Int. Cl.[6] ..... B65D 47/14; B65D 47/28

[52] U.S. Cl. ..... 215/251; 215/252; 222/548; 222/549; 222/559

[58] Field of Search ..... 222/559, 548, 222/549; 215/201, 205, 209, 214, 216, 217, 218, 224, 225, 250, 251, 253, 256, 252

[56] References Cited

U.S. PATENT DOCUMENTS

| | | | |
|---|---|---|---|
| 3,695,476 | 10/1972 | Ruekberg . | |
| 3,828,981 | 8/1974 | Linkletter | 222/549 X |
| 4,126,240 | 11/1978 | Brach . | |
| 4,371,089 | 2/1983 | Barendregt . | |
| 4,402,415 | 9/1983 | Hopley . | |
| 4,434,904 | 3/1984 | D'Amico et al. . | |
| 4,458,821 | 7/1984 | Ostrowsky . | |
| 4,478,343 | 10/1984 | Ostrowsky . | |
| 4,494,663 | 1/1985 | Bertaud et al. . | |
| 4,540,100 | 10/1985 | Willis . | |
| 4,546,893 | 10/1985 | Stull . | |
| 4,562,931 | 1/1986 | Brach et al. . | |
| 4,709,823 | 12/1987 | Beck et al. . | |
| 4,746,035 | 5/1988 | Anderson et al. . | |
| 4,801,030 | 1/1989 | Barriac . | |
| 4,923,073 | 5/1990 | Wilde | 215/252 |
| 5,038,951 | 8/1991 | Rizzardi . | |
| 5,085,333 | 2/1992 | Dutt et al. . | |
| 5,088,613 | 2/1992 | Dutt et al. . | |
| 5,131,550 | 7/1992 | Thompson . | |
| 5,135,123 | 8/1992 | Nairn et al. . | |
| 5,158,192 | 10/1992 | Lataix . | |
| 5,197,619 | 3/1993 | Margaria . | |
| 5,325,999 | 7/1994 | Gueret | 222/549 X |

*Primary Examiner*—Stephen P. Garbe
*Assistant Examiner*—Nathan J. Newhouse
*Attorney, Agent, or Firm*—Emrich & Dithmar

[57] ABSTRACT

A tamper evident closure construction is provided for use with a container of the type having a neck with a discharge orifice therein. The tamper evident closure construction includes a dispenser cap and a unitary, one-piece, tamper evident closure cover. The dispenser cap includes a base connected to the neck and a dispensing portion connected to the base. The tamper evident closure cover consists of an overcap and a container closure cap separated by frangible webs which, when permanently disengaged, allow access to the dispensing portion and provide a visual indication of tampering. The container closure cap is fastened directly to the neck of the container and includes a breakaway tamper-band, or alternatively, a snap-fit abutment arrangement, which provides an indication of attempts to remove the container closure cap from the neck. The skirt of the container closure cap is directly coupled to the neck of the container, and includes an annular bead on an inside surface and an annular flange which cooperate to secure and seal the base of the dispenser cap against the neck around the discharge orifice.

11 Claims, 1 Drawing Sheet

TAMPER EVIDENT CONTAINER CLOSURE

BACKGROUND OF THE INVENTION

1. Field of the Invention

The present invention relates to container closures and, more particularly, to a tamper evident container closure construction of the type providing indication of previous opening and possible tampering with a container's contents.

2. Description of the Prior Art

In recent years there has been an emphasis on ensuring that the dispensing (neck) openings of containers are provided with tamper evident closures and, more particularly, closures that are resistant to opening and which, when opened, provide an indication of such opening. A known type of tamper evident closure construction includes multi-part cap closures whereby an overcap, which encloses a container dispenser opening, is connected by way of tamper evident frangible or snap-fit connections to a base cap that further incorporates a second tamper evident feature. The overcap requires removal prior to a dispensing operation and may be discarded or, if possible, replaced on the dispenser. The base cap is a protective cap which functions to provide an indication of tampering when an attempt has been made to remove the base cap so as to refill or change the contents of the container.

U.S. Pat. No. 4,546,893 shows one construction of a multi-part cap closure including an overcap and a base portion, the latter being snapped into position on the container and held permanently thereon by means of cooperative retainer shoulders. When the overcap is initially turned or otherwise disturbed, frangible webs, connecting it to the base portion, break and their resilience causes a tamper evident ring to shift laterally attracting attention of one handling the container and providing a warning of tampering. The base portion is itself of tamper evident construction since it provides an indication of tampering therewith due to its easily deformable nature. Thus, any attempt to remove the base portion and overcap combination, tampering with the container contents and then re-attaching the overcap and base portion combination, would be readily detected. This is because, even though the overcap remains intact with the base portion, the prying off of the base portion would necessarily have caused it to become deformed. While the tamper evident feature of the base portion is useful, the base portion itself is not in any way uniquely constructed to seal and secure the dispenser to the neck of the container.

U.S. Pat. No. 4,709,823 discloses yet another construction of a tamper evident closure for use in connection with pull-to-open push-to-close (push-pull) type dispensing caps and the like. When an overcap is assembled to a base portion by frangible connections, access to the push-pull device is blocked. The overcap and base portion combination is restrained against removal by the abutment of the top surface areas of a plurality of axially extending and radially inwardly projecting ribs, formed on the base portion, against a radially outwardly extending bead or lip on the push-pull closure. Rotation of the push-pull closure in the direction of removal of same together with the overcap and base portion is prevented by the anti-rotation engagement of radially outwardly extending projections formed on the container neck with the axially extending ribs on the base portion. Thus, the container cannot be opened and the contents thereof cannot be tampered with or dispensed. In order to provide access to the push-pull dispensing valve, the overcap must be severed by breaking of the frangible connections. When this happens, the overcap is permanently disengaged. However, the base portion remains in position on the container providing an indication of tampering. Once the base portion is separated from the overcap, it can be slid downwardly along the neck of the container toward the shoulders of the bottle. Depending on the length of the neck, the base portion may be displaced sufficiently from a threaded portion of the push-pull closure to permit its removal, the contents tampered with and then reassembled. There is no tamper evident indication available other than that provided by the initial disengagement of the overcap from the base portion. The base portion of the tamper evident container closure and the threaded portion of the push-pull closure are arranged as cooperating skirts around the container neck. While this two piece skirted construction is highly effective, unfortunately, it is also expensive and difficult to manufacture.

Yet another construction is illustrated in U.S. Pat. No. 4.764,035 involving dispensers of the pump and aerosol varieties. A protective overcap covering the dispenser's actuator is connected to a base closure cap of the dispenser actuator, which closure cap is employed for mounting the dispenser actuator on a liquid container. Circumferentially spaced-apart stops are provided between the overcap and the closure cap permitting limited turning movement of the overcap prior to separation from the closure cap. Cooperating flanges, acting between the overcap and closure cap, retain the overcap in place by snap-fitting engagement. Frangible connections above the cooperating flanges provide for permanent separation of an upper portion of the overcap permitting access to the dispenser actuator. The closure cap is also provided with a tamper evident ring that breaks away from the closure cap upon turning same in the direction of opening. A two-piece, non-integral construction of closure cap and overcap, as in the above-described container closure, results in unnecessary increases in cost of assembly and manufacture. Also, the base of the pump dispenser actuator is dimensioned to be received by the closure cap and does not mate directly into the container discharge orifice. This is important because conventional push-pull dispenser caps are generally provided with an outer base skirt which is internally threaded to facilitate screwing the same onto the container neck. Since the closure cap of the '035 patent is threaded directly onto the container neck, a push-pull type dispenser cap could not be substituted for the pump-type dispenser actuator of the disclosed embodiment.

It would therefore be an advance in the art to provide an improved, unitary, one-piece, tamper evident cap closure for use with a wide variety of dispenser caps, particularly push-pull type dispenser caps, which tamper evident closure and dispenser cap combination overcomes the shortcomings of conventional constructions.

SUMMARY OF THE INVENTION

It is a general object of the present invention to provide an improved tamper evident closure construction for use with a container which is economical and easy to manufacture.

It is another object of the present invention to provide a unitary, one-piece, tamper evident closure construction including at least two tamper evident elements which are joined to a tamper evident cover. One tamper evident element indicates prior access to the dispensing portion of a dispenser cap connected to a container's neck, while the other tamper evident element indicates possible tampering with the container's contents by way of removal of the dispenser cap from the neck.

It is yet another object of the present invention to provide a tamper evident closure construction including a tamper evident cover having an overcap and a closure cap wherein the closure cap is constructed so as to secure and seal a base of the dispenser cap to the container neck, such that removal of the dispenser cap from the neck can only be accomplished by removing the securing closure cap as well as the tamper evident element associated therewith.

It is yet a further object of the present invention to provide a tamper evident closure construction including a dispenser cap having a base which does not extend over the outside surface of the container neck but, instead, is snap-fitted into a closure cap which closure cap includes a skirt that is threaded (or snapfitted) into position over the outside surface of the container neck. The closure cap skirt integrally incorporates both a tamper evident feature as well as a means for attaching the closure cap and dispenser cap to the container using a unitary one-piece skirted construction, thus providing a less expensive closure than conventional two-piece skirted constructions.

These and other features of the invention are attained by providing a tamper evident closure construction for use with a container of the type having a discharge orifice therein. The tamper evident closure construction includes a dispenser cap for controlling the dispensing of materials through the discharge orifice. The dispenser cap, in turn, includes a base connected to the neck and a dispensing portion connected to the base. The tamper evident container closure construction also includes a unitary, one-piece, tamper evident closure cover including an overcap and a container closure cap joined by at least one tamper evident connection. The at least one tamper evident connection is severable to allow access to the dispensing portion and provide a visual indication of possible tampering. The container closure cap functions to fasten the container closure construction directly to a neck of the container and indicates tampering with the container closure cap in the nature of attempts to remove the container closure cap from the neck. The container closure cap further operates to secure and seal the base of the dispenser cap to the neck once assembled thereto.

The tamper evident closure cover provides an indication of tampering, in accordance with a first embodiment, by way of a skirt threadedly engageable with the neck and a breakaway tamperband on the skirt engageable with the neck to resist unscrewing of the skirt from the neck. Unscrewing of the skirt from the neck severs the breakaway tamperband from the skirt and provides a visual indication of tampering.

Alternatively, in a second preferred embodiment of the tamper evident closure construction, indication of tampering is achieved by way of an abutment on the container closure cap which, during initial assembly, is disposable in snap-fit engagement with a groove on the neck of the container. Any attempted disengagement or prying off of the container closure cap from the neck of the container would cause deformation of the container closure cap and provide a visual indication of tampering.

Preferably, the at least one tamper evident connection consists of a plurality of frangible webs and the dispenser is a push-pull type dispenser.

The container closure cap also includes a cylindrical skirt, an annular flange extending inwardly along a top surface of the skirt, and a radially extending bead on an inside annular surface of the skirt, the radially extending bead and the annular flange being dimensioned to receive the base of the dispenser cap in snap-fit engagement therebetween. The closure cap operates to secure and seal the base of the dispenser cap to the container's neck by way of a cylindrical skirt provided therewith having an inner annular surface which cooperates with an annular wedge extending from a bottom surface of the base of the dispenser cap to engage an uppermost lip on the neck of the container.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENTS

Figure 1:
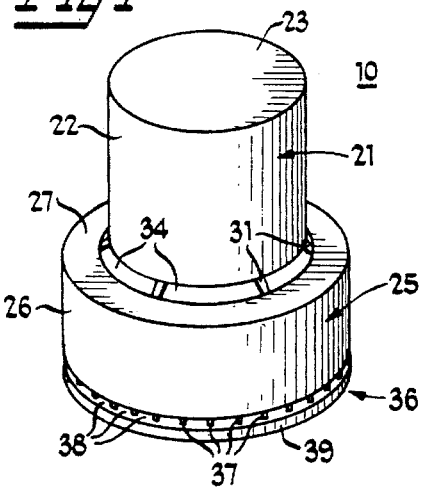
FIG. 1 is a perspective view of a unitary, one-piece, tamper evident closure construction, constructed in accordance with and embodying the features of a first embodiment of the present invention, including a dispenser cap and a closure cover.
Figure 3:
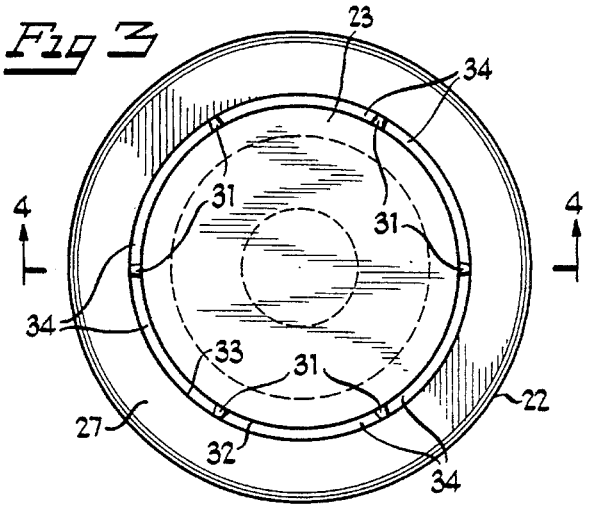
FIG. 3 is an enlarged top plan view of the tamper evident closure construction of FIG. 1.

Referring to FIGS. 1–4, there is illustrated a tamper evident closure construction, generally designated by the numeral 10, constructed in accordance with and embodying the features of a first embodiment of the present invention. FIG. 1 shows a perspective view of tamper evident closure construction 10 in its fully assembled form for use with a container 100 to be described below in connection with FIG. 4.

Figure 2:
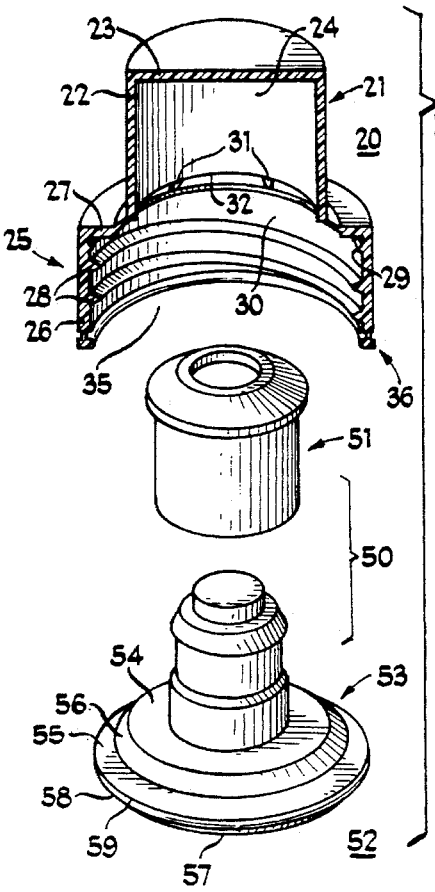
FIG. 2 is an exploded, perspective view of the tamper evident closure construction of FIG. 1, with the closure cover shown in partial vertical section.

As is best shown in FIG. 2, the tamper evident closure construction 10 is of a three-part construction, including a tamper evident closure cover 20 and a push-pull dispenser cap 50, the latter comprising a dispenser cap cover 51 and an upstanding dispenser cap section 52. The three elements recited above cooperate to provide container 100 with a tamper evident dispenser cap, which not only allows the contents of container 100 to be dispensed in the manner to be described below, but also includes two telltale indications of possible tampering with the container contents.

Tamper evident closure cover 20 includes a cup-shaped overcap 21, having a cylindrical side wall 22 and a circular end wall 23, which cooperate to define an inner cavity 24. Closure cover 20 further includes a base closure cap 25 having a cylindrical skirt 26, of greater diameter than overcap cylindrical wall 22, with an internal screw thread 28. A radially inwardly extending annular flange 27 is integral with the skirt 26 at its upper end and has an inner diameter slightly greater than the diameter of the overcap side wall 22. A radially inwardly extending circumferential bead 29 is formed along an inner annular surface 30 of threaded skirt 26 between the flange 27 and the upper end of the thread 28. A plurality of circumferentially spaced frangible webs 31 extend between an open end 32 of overcap cylindrical wall 22 and an inner edge 33 of annular flange 27, being integral with each for supporting the overcap 21 a slight distance above the flange 27. Between frangible webs 31 are slots 34. Webs 31 join the closure cap 25 to the overcap 21 so as to remain under tension when closure construction 10 is assembled to the neck 101 of container 100.

Joined to an open end 35 of skirt 26 is a tamperband 36, consisting of a series of circumferentially arranged frangible connectors 37 separated by small spaces 38, and a removable ring 39 coaxial with the skirt 26, the connectors 37 extending axially from the skirt 26 to the ring 39 and being integral with each.

The dispenser cap 50 is a push-pull cap of the type having an outer valving member or dispenser cap cover 51, which is movable axially with respect to the upstanding dispenser cap section 52 between open and closed conditions. Push-pull dispensing caps are well known and will not be described further, except to explain the unique construction of the base 53 of upstanding dispenser cap section 52 which has been dimensioned to be snap-fitted into engagement with the closure cap 25 by the cooperation of flange 27 and bead 29. More specifically, base 53 consists of a first annular wall 54 and a second annular wall 55 joined by an inclined annular wall 56, all of which walls are integral and of approximately equal thickness. An annular wedge 57 extends from below base surface 58 of second annular wall 55. An outer edge surface 59 of second annular wall 55 is partially rounded and the wall 55 is dimensioned to snap past the bead 29 into snap-fit engagement with closure cap 25 between the flange 27 and the bead 29. The second annular wall 55 is dimensioned to fit beneath the annular flange 27, with the inclined wall 56 disposed beneath the frangible webs 31 and slots 34.

Figure 4:
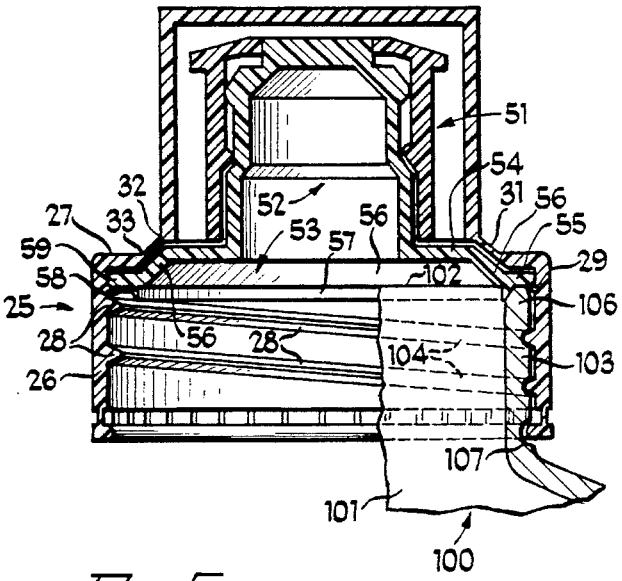
FIG. 4 is a vertical sectional view of the closure construction of FIG. 1, taken generally along line 4—4 in FIG. 3, and showing in fragmentary vertical section the threaded neck of a container to which the closure construction is assembled.

The tamper evident closure construction 10 shown in FIGS. 1–4 is intended to be used with container 100, one construction of which is shown in FIG. 4 in accordance with the first embodiment of the present invention. Container 100 could be any container having a neck 101 defining a discharge orifice 102. Neck 101 is defined by a cylindrical wall 103 with external threads 104 which are configured for threaded engagement with threaded skirt 26 of closure cap 25. The distal end of neck 101 defines a lip 106 which is dimensioned so as to be cooperatively received in a wedge fit with annular wedge 57. Annular wedge 57 is sloped to allow lip 106 to slide into position against base surface 58 of second annular wall 55 when the tamper evident closure construction 10 is screwed on neck 101. This assures a secure fit and a tight seal between the container 100 and the dispenser cap 50. Also, when dispenser cap cover 51 is in the closed position, as shown in FIG. 4, the container's contents are protected against ambient conditions.

Adjacent to the bottom of neck 101, there is provided an annular groove 107 dimensioned to matably receive the removable ring 39 of tamperband 36 in snap-fitted engagement during assembly of the tamper evident closure construction 10 to container 100.

Figure 5:
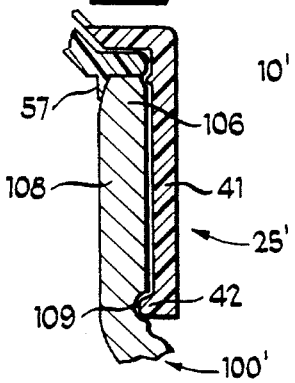
FIG. 5 is a further enlarged, fragmentary, vertical sectional view of a tamper evident closure construction according to a second embodiment of the present invention, shown assembled to a non-threaded container neck.

In an alternative embodiment, shown in FIG. 5, a closure cap 25', having a cylindrical non-threaded skirt 41 is substituted for the threaded skirt 26 of closure cap 25, for engagement with a non-threaded neck 108 of a container 100'. Non-threaded neck 108 is provided adjacent to the bottom thereof with an annular groove 109, dimensioned to matingly receive in snap-fit engagement a curved, circumferential abutment 42, provided at a bottom end of non-threaded neck 108, during assembly of the tamper evident closure construction 10' to neck 108. With the exception of structural differences described above in connection with the cap closures 25 and 25' of the respective first and second embodiments, the two embodiments of the present invention are otherwise identical.

Tamper evident closure cover 20, as well as dispenser cap 50, may be constructed from plastic or like material and injection molded into the shape generally shown in the drawings, so that the closure cover 20 is of unitary, one-piece construction.

The assembly of tamper evident closure construction 10, of the first embodiment of the present invention, to container 100 will now be described in greater detail. Dispenser cap cover 51 is initially snap-fitted over upstanding dispenser cap section 52 and pushed into the closed position. Thereafter, dispenser cap 50 is assembled with the closure cover 20 by snapping the base 53 of dispenser cap 50 into engagement with closure cap 25, as explained above, disposing the dispenser cap cover 51 within the overcap 21, as is best shown in FIG. 4.

Once the dispenser cap 50 is snap-fitted inside the unitary, one-piece, closure cover 20, the whole structure is assembled to the neck 101 of container 100 in the manner shown in FIG. 4. Initially, the closure cover 20 is threaded onto the externally threaded cylindrical wall 103 of neck 101 until the removable ring 39, which is integral with the closure cap 25, is brought into snap-fit engagement with the annular groove 107. As this occurs, lip 106 of neck 101 will be caused to become securely engaged below base surface 58 of second annular wall 55 and between annular wedge 57 and the bead 29. The tight-fit arrangement of dispenser cap 50 and closure cover 20 to container neck 101 results in a secure and leak-proof container construction incorporating two very different tamper evident features.

The first tamper evident feature is provided by a fracture line defined by frangible webs 31. Upon application of an external force to the overcap 21, as by manually grasping the same and turning the overcap 21 in either direction, or by pushing against overcap cylindrical wall 22, the overcap 21 will become separated from the closure cap 25 as the frangible webs 31 are broken. Once the overcap 21 is removed, the absence of the overcap provides a visible indication of possible tampering. Without overcap 21, dispenser cap cover 51 is manually accessible and opening thereof is made possible. Once opened, the contents of container 100 can be dispensed therethrough. However, because the base 53 of upstanding dispenser cap section 52 remains engaged between closure cap 25 and lip 106 of neck 101, even after the overcap 21 is broken off, refilling the container may not be possible. A broken overcap 21 serves as an indication that the container 100 may not be entirely full and/or that the contents may have been tampered with.

Any effort to unscrew the closure cap 25, so as to remove the dispenser cap 50 entirely, will cause frangible connectors 37 of tamperband 36 to break, causing removable ring 39 to become separated from cylindrical threaded skirt 26. The separated ring 39 provides the second tamper evident feature of tampering. When the removable ring 39 is separated from the skirt 26 and the closure cap 25 unscrewed so as to be removed from the neck 101, dispenser cap 50 which is snap-fitted onto the cylindrical threaded skirt 26, will ultimately also become disengaged from the neck 101. In this way, the contents of the container are accessible and can be tampered with. Thereafter, the closure cap 25 and dispenser cap 50 can be screwed back onto the neck 101 for reuse with container 100.

The absence or, alternatively, the detachment of removable ring 39 from closure cap 25 serves as an indication of possible tampering with the container's contents. This is true whether or not the overcap 21 is affixed to the closure cap 25. Thus, if the removable ring 39 appears loose, or is missing, a purchaser of the container 100 will be forewarned that its contents may have been tampered with. Similarly, if the overcap 21 is loose, or is missing entirely, a purchaser will quickly recognize that some of the container's contents already may have been dispensed or previously tampered with.

Alternatively, in the second preferred embodiment, shown in FIG. 5, tamper evident closure construction 10' is adapted for snap-fit engagement with the non-threaded neck 108 of the container 100'. Assembly of dispenser cap 50 within inner cavity 24 of overcap 21, as well as within closure cap 25' which closure cap 25' is provided with a non-threaded cylindrical non-threaded skirt 41, is substantially as explained previously in connection with the description thereof of closure cap 25 of the first preferred embodiment. Tamper evident closure construction 10' is applied to container 100' simply by pressing it down to a position where curved abutment 42 snaps into the annular groove 109 on the neck 108. As in the first embodiment, a secure and tight fit engagement among the container 100' and the tamper evident closure construction 10' is assured by the cooperation of annular wedge 57, lip 106, and cylindrical non-threaded skirt 41 of closure cap 25'. Any attempted disengagement, or prying off, of closure cap 25' from neck 108, would cause deformation of closure cap 25' providing an instant visual indication of tampering.

The second preferred embodiment differs from the first to the extent that the second tamper evident feature of the second embodiment is intended for use with containers whose contents are not intended to be replenished or changed. By contrast, the second tamper evident feature of the first preferred embodiment is intended to be used with containers, such as water bottles and the like, whose contents a purchaser would expect to replenish or change.

In both preferred embodiments, the first tamper evident feature, provided by frangible webs 31 which integrally join the overcap 21 to the closure cap 25 (25'), allows access to the contents of a container when the overcap 21 is broken off, while leaving intact a second tamper evident feature, namely that provided by tamperband 36 (or by abutment 42), which provides an alternate indication of tampering, such as when an attempt has been made to remove the closure cap 25 (25') so as to refill or change the contents of the container 100 (100').

In accordance with the presently preferred embodiments, because the base 53 of the dispenser cap 50 of the present invention is constructed in a manner which eliminates the use of a threaded skirt—common in conventional push-pull type dispenser caps—the one-piece skirted construction herein disclosed, allows the closure cap 25 (25') to be threaded (snap-fitted) directly onto the neck 101 (108) of a container 100 (100'), instead of on a threaded skirt of a dispenser cap. Hence, a more simplified and less expensive construction is envisioned.

It is envisioned that, while the second embodiment of FIG. 5 has been described as having a non-threaded container neck construction, a threaded neck construction—all else the same— can be substituted therefor without affecting the tamper evident nature of closure cap 25' as described hereinabove.

From the foregoing, it can be seen that there has been provided an improved tamper evident container closure construction which is economical, easy to manufacture, easily engageable with an appropriately sized neck of a container, easily adaptable for use with a variety of dispenser caps, including push-pull type dispenser caps, and which provides two different telltale indications of tampering of a container's contents.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A tamper evident closure construction for use with a container of the type having a neck with a discharge orifice therein, comprising:

a dispenser cap for controlling the dispensing of materials through the discharge orifice, said dispenser cap including a base adapted to be connected to the neck and a dispensing portion connected to said base; and a unitary one-piece tamper evident closure cover including an overcap and a container closure cap joined by at least one tamper evident connection, said at least one tamper evident connection being severable to separate said overcap from said closure cover for allowing access to said dispensing portion and for providing a visual indication of tampering, said container closure cap being adapted to be fastened directly to the neck of the container and including means for indicating attempts to remove said container closure cap from the neck, said container closure cap further including means for securing and sealing the base of said dispenser cap to the neck of the container, said container closure cap including a cylindrical skirt and an annular flange extending radially inwardly from said skirt and a bead spaced axially from said flange and extending radially inwardly from said skirt, said bead and said flange being dimensioned to receive the base of said dispenser cap in snap-fit engagement therebetween.

2. The tamper evident closure construction of claim 1, wherein said means for indicating includes a skirt threadedly engageable with the neck and a breakaway tamperband on said skirt engageable with said neck to resist unscrewing of said skirt from the neck, whereby unscrewing of said skirt from the neck severs said tamperband from said skirt to provide a visual indication of tampering.

3. The tamper evident closure construction of claim 1, wherein the neck of the container is of the type including an annular groove and said means for indicating includes an abutment on said container closure cap disposable in snap-fit engagement with the annular groove such that any attempted disengagement causes deformation of the container closure cap to provide a visual indication of tampering.

4. The tamper evident closure construction of claim 1, wherein said at least one tamper evident connection consists of a plurality of frangible webs.

5. The tamper evident closure construction of claim 1, wherein said means for securing and sealing includes a cylindrical skirt having an inner annular surface which cooperates with an annular wedge extending from a bottom surface of the base of said dispenser cap to engage an uppermost lip on the neck of the container.

6. The tamper evident closure construction of claim 1, wherein said dispenser cap is a push-pull type dispenser cap.

7. The tamper evident closure construction of claim 2, wherein said dispenser cap is a push-pull type dispenser cap.

8. The tamper evident closure construction of claim 3, wherein said dispenser cap is a push-pull type dispenser cap.

9. The tamper evident closure construction of claim 4, wherein said dispenser cap is a push-pull type dispenser cap.

10. The tamper evident closure construction of claim 1, wherein said dispenser cap is a push-pull type dispenser cap.

11. The tamper evident closure construction of claim 5, wherein said dispenser cap is a push-pull type dispenser cap.

* * * * *